US007540943B2

(12) United States Patent
McPherson

(10) Patent No.: US 7,540,943 B2
(45) Date of Patent: Jun. 2, 2009

(54) SHAPED SLOT VACUUM DEWATERING BOX COVER

(75) Inventor: Douglas R. McPherson, East Granby, CT (US)

(73) Assignee: AstenJohnson, Inc., Charleston, SC (US)

( * ) Notice: Subject to any disclaimer, the term of this patent is extended or adjusted under 35 U.S.C. 154(b) by 331 days.

(21) Appl. No.: 10/579,004

(22) PCT Filed: Nov. 12, 2004

(86) PCT No.: PCT/US2004/037823

§ 371 (c)(1),
(2), (4) Date: May 11, 2006

(87) PCT Pub. No.: WO2005/049916

PCT Pub. Date: Jun. 2, 2005

(65) Prior Publication Data

US 2007/0144699 A1 Jun. 28, 2007

Related U.S. Application Data

(60) Provisional application No. 60/520,739, filed on Nov. 17, 2003.

(51) Int. Cl.
*D21F 1/52* (2006.01)

(52) U.S. Cl. ..... 162/374; 162/363; 162/351; 162/352

(58) Field of Classification Search ..... 162/211, 162/217, 351, 352, 363, 364, 366, 374
See application file for complete search history.

(56) References Cited

U.S. PATENT DOCUMENTS

| | | | | |
|---|---|---|---|---|
| 1,608,202 | A * | 11/1926 | Compton | 162/374 |
| 1,832,844 | A * | 11/1931 | Cofrin | 162/217 |
| 2,957,522 | A | 10/1960 | Gatke | |
| 3,446,702 | A | 5/1969 | Buchanan | |
| 3,869,344 | A | 3/1975 | Hunt | |
| 3,871,953 | A | 3/1975 | Lee et al. | |
| 3,928,125 | A * | 12/1975 | Poeschl | 162/352 |
| 4,909,906 | A | 3/1990 | Bartelmuss et al. | |
| 5,147,508 | A | 9/1992 | Sweet | |
| 5,858,175 | A * | 1/1999 | Feiler | 162/374 |
| 6,221,215 | B1 | 4/2001 | Halmschlager et al. | |
| 2004/0074623 | A1 * | 4/2004 | Bartelmuss et al. | 162/352 |

FOREIGN PATENT DOCUMENTS

| | | |
|---|---|---|
| DE | 29822998 | 2/1999 |
| EP | 0 410 556 | 1/1991 |
| EP | 0454973 | 11/1991 |
| EP | 0945545 | 9/1999 |
| EP | 1411166 | 4/2005 |

* cited by examiner

*Primary Examiner*—Eric Hug
(74) *Attorney, Agent, or Firm*—Volpe and Koenig, P.C.

(57) ABSTRACT

A cover for a vacuum dewatering box that is formed from a plurality of blocks, each including a wear surface, is provided. At least some of the blocks are spaced apart to form at least one generally longitudinally oriented slot through the cover, with a shape and size of the at least one slot being determined by at least one of a location of and a shape of the blocks. Preferably, the at least one slot is formed with a zig-zag or herringbone pattern, and can be used on a suction box or Uhle box on a papermaking machine. A vacuum dewatering box having this type of cover is also provided.

27 Claims, 3 Drawing Sheets

SHAPED SLOT VACUUM DEWATERING BOX COVER

BACKGROUND

The present invention concerns a vacuum assisted dewatering box for use in a papermaking machine, such as a Uhle box, a felt suction box, or other types of suction boxes which assist in dewatering the sheet and the fabric upon which it is conveyed in the papermaking machine. In particular, the invention is directed to a dewatering box cover, wherein the cover is comprised of a plurality of block type components which are assembled in a desired manner.

During the process of making paper in a modern papermaking machine, a highly aqueous slurry of about 99% water and about 1% cellulosic fibers is ejected at high velocity either onto an endless moving forming fabric in a single fabric forming arrangement, or in between two converging forming fabrics in a two fabric layout. The fabric or fabrics will pass over one or more vacuum assisted dewatering boxes, typically called a suction box in the fourdrinier section of a papermaking machine, to assist in water removal and consolidate the slurry into a nascent sheet. Upon leaving the forming section, the newly formed sheet has a very high water content of about 75-80%, the remainder being solids. The embryonic sheet is then transferred to the press section where it contacts at least one press fabric which carries it through one or more press nips where further water is pressed from the sheet by mechanical means and passes into the press fabric. The press fabric passes over at least one vacuum assisted dewatering box, typically referred to as a Uhle box in the press section, where water and contamination is removed from the fabric. The sheet, which now typically has a moisture content of about 45-35% continues into the dryer section where the remainder of its water is removed by evaporative means.

Vacuum assisted dewatering boxes are also utilized in other, similar continuous processes, such as in the manufacture of multi-ply boards. In these processes, the sheet is formed in layers and the fabric(s) carry the sheet through several presses where it is dewatered and eventually dried. Vacuum assisted dewatering boxes are employed in the press sections of these machines as well, where the fabric and the product being conveyed upon it must also be dewatered as in the papermaking process.

The vacuum assisted dewatering boxes used in papermaking and like machines have typically been provided with a ceramic cover, to resist the abrasive wear caused by the passage of the fabric and product over its surface. A straight slot extends in the CD across the width of the cover and across the width of the fabric has been effective in providing even drainage. The slot sizes range in linear MD width from about ⅜ inch to about 3.0 inches (1-7.5 cm). However, it has been found that this type of slot arrangement is unsatisfactory in certain instances, such as when a seamed press fabric passes over the slot. The fabric makes a loud popping sound as the seam flap (which is that portion of the batt and base fabric which is extended over the seam area to prevent or inhibit seam marking) is pulled down into the slot. This also causes premature wear at the seam, thus reducing fabric life.

It is known that one means of reducing or significantly eliminating these aforementioned deficiencies of the slot type suction box cover is to utilize one having a herringbone, zigzag or intermittent slot design. The term "herringbone" as used herein in connection with a suction box cover is understood to describe a discontinuous or non-linear slot opening, and this term is also commonly used in the same manner in the industry. These types of covers have been shown to be effective in reducing seam wear by providing more support for the press fabric seam as the fabric moves over the openings. See for example Gatke U.S. Pat. No. 2,957,522, Hood et al. EP 410556, and Bartelmuss et al. U.S. Pat. No. 4,909,906. For the most part, these herringbone covers have not been available in a ceramic design as there was not an economical means of producing them. It will be appreciated by those of skill in the art that it is extremely difficult and costly to machine these very tough ceramic materials so as to provide the desired herringbone type slot opening. A ceramic design with a serpentine cover has been used but it does not provide equal open area across the felt width.

Some suction box covers are presently molded from a plastic material, usually UHMW (Ultra High Molecular Weight) polyethylene. The slots in the covers are routed to form the herringbone or non-continuous slot. The problem with these UHMW covers is that they wear quickly on higher speed machines resulting in increased loss of production due to the need to change the covers more frequently, and potentially increased damage to the press felts due to uneven fabric wear, particularly at the seam.

Unfortunately, the typical methods for manufacturing this type of cover in ceramic have not been either cost effective, or simply could not be used to produce the necessary configuration.

The present invention seeks to overcome these problems and provide a novel, economical means of constructing a ceramic herringbone type suction box cover for use in a papermaking or similar machine. The novel cover provides improved wear life due to its ceramic surface construction, and a non-continuous slot arrangement so as to increase fabric wear life by reducing wear at the seam. It would also be desirable to provide a construction method that allows for a reduced manufacturing cost, even when working with the desired ceramic materials for the covers.

SUMMARY

Briefly stated, the present invention provides a cover for a vacuum dewatering box that is formed from a plurality of blocks, each including a wear surface. At least some of the blocks are spaced apart to form at least one generally longitudinally oriented slot through the cover, with a shape and size of the at least one slot being determined by at least one of a location of and a shape of the blocks. A vacuum dewatering box having this type of cover is also provided. A preferred application for the cover of the present invention is for use in a papermaking or like machine.

The cover is preferably formed using a plurality of ceramic coated blocks over which the fabric(s) passes in sliding contact. These blocks are advantageously trapezoidal or triangular in shape, but other shapes are possible. These blocks are located on the cover, either by mechanical attachment to CD oriented supports or on rods which pass through them, so as to form a cover for the suction box which includes a non-linear slot, which may be continuous or non-continuous, through which vacuum from the box may act on the fabric. Preferably, this slot will have somewhat of a herringbone, zigzag or other intermittent arrangement. By constructing the vacuum dewatering box cover in this manner, the high cost of machining the tough ceramic material to provide a discontinuous slot is significantly reduced, and the cover can be made economically and with a variety of opening arrangements. The vacuum dewatering box covers of the present invention find utility in the forming section of papermaking and like machines, or in the press section where they may be used as covers for Uhle boxes.

The blocks are advantageously trapezoidal or triangular in shape and at the least the fabric bearing surfaces are comprised of a ceramic material such as silicon nitride or aluminum oxide. The blocks are preferably arranged on the CD support so that they do not form a continuous straight line opening to the interior of the suction box. The blocks forming the suction box cover are either bolted, attached by adhesive or some other mechanical fastening means to the support, or they are aligned on a CD oriented rod or interlocking mechanism which extends parallel to the supports. The construction provides a simple and economical means of creating a herringbone, zigzag or intermittent opening in a ceramic suction box cover.

BRIEF DESCRIPTION OF THE DRAWINGS

The foregoing summary, as well as the following detailed description of the preferred embodiments of the invention, will be better understood when read in conjunction with the appended drawings. For the purpose of illustrating the invention, there are shown in the drawings embodiments which are presently preferred. It should be understood, however, that the invention is not limited to the precise arrangements shown. In the drawings.

DETAILED DESCRIPTION OF THE PREFERRED EMBODIMENTS

Figure 3:
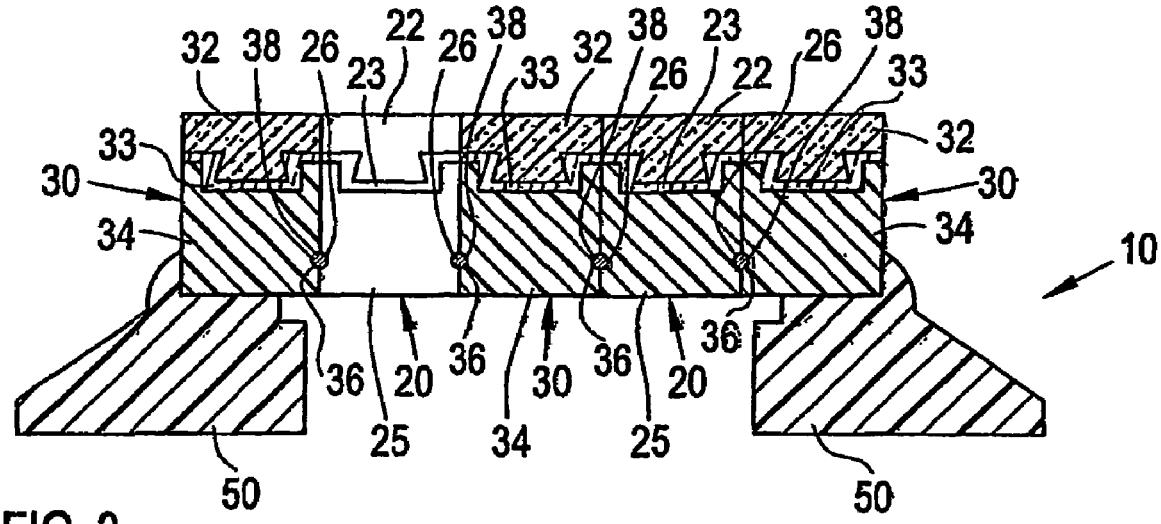
FIG. 3 is a cross-sectional view through the cover of FIG. 1, taken along line 3-3 in FIG. 1.

Certain terminology is used in the following description for convenience only and is not considered limiting. The words "lower" and "upper" designate directions in the drawings to which reference is made. "CD" refers generally to the cross-direction of a moving belt, for example in papermaking machines, and "MD" refers to the machine direction or direction of travel of a moving belt, such as a papermaking fabric in a papermaking machine. Additionally, the terms "a" and "one" are defined as including one or more of the referenced item unless specifically noted. The term "herringbone" is as recited above. "Vacuum dewatering box" and "vacuum assisted dewatering box" are used interchangeably and refer to any vacuum assisted dewatering arrangement, such as a suction box or Uhle box in a papermaking machine.

Figure 2:
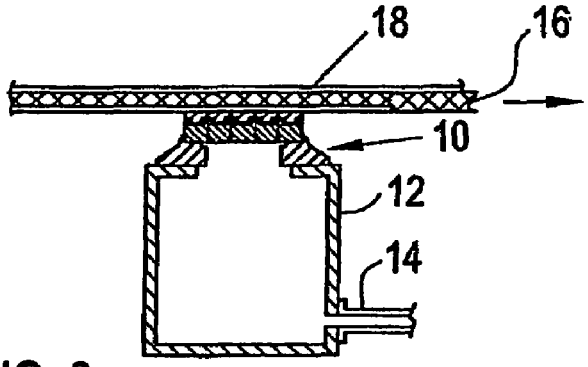
FIG. 2 is a cross-sectional view through a vacuum dewatering box in accordance with the present invention, shown with the cover of FIG. 1.
Figure 1:
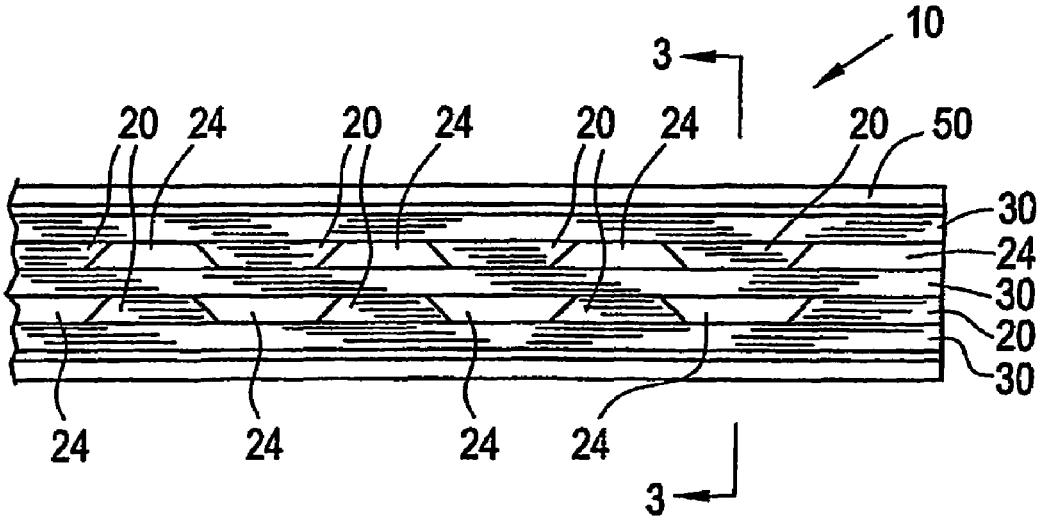
FIG. 1 is a plan view of a first embodiment of a vacuum dewatering box cover according to the present invention, utilizing preferred trapezoidal shaped blocks to form a non-linear, non-continuous slot opening.

Referring to FIG. 1, the simplest form of the construction of a vacuum dewatering box cover 10 in accordance with the teaching of the present invention is shown. The cover 10 is used on a vacuum dewatering box 12, as shown in FIG. 2, and is preferably used to remove moisture from a papermaking fabric or felt 16. Such vacuum dewatering boxes 12 may be used as a suction box in the fourdrinier section of the papermaking machine, or may be used as an Uhle box in the press section. It can also be used in connection with other types of dewatering or moisture removing operations, and is not limited solely to the preferred use in a papermaking machine.

As shown in FIG. 2, the vacuum dewatering box 12 preferably provides an enclosed space which is connected to a vacuum source 14 in order to draw a vacuum in the vacuum dewatering box 12. As shown, this can be used for dewatering the papermaking fabric 16, which carries a paper sheet 18 as it is being formed. The vacuum dewatering box 12 generally extends in the CD and the papermaking fabric 16 travels in the MD, indicated by the arrow in FIG. 2, such that the underside of papermaking fabric 16 is drawn downwardly against the cover 10 of the vacuum dewatering box 12 by the vacuum force acting through a slot in the cover 10.

Referring to FIGS. 1 and 3, the cover 10 is shown in detail. The cover 10 is preferably formed of a plurality of blocks 20, each of which includes a wear resistant surface element or coating 22, as shown in detail in FIG. 3. Preferably, the wear-resistant element 22 is formed of a ceramic material such as silicon nitride or aluminum oxide. However, other materials may be utilized which have a high wear resistance and smooth surface characteristics. The wear resistant surface element 22 is preferably mounted in a base component 25 using an adhesive or potting compound 23 to form the block 20. The base component 25 is preferably formed of fiberglass, UHMW polyethylene, stainless steel or any other suitable material. In the preferred embodiment, the wear-resistant elements 22 of the blocks 20 include a downwardly extending projection, preferably with a dove-tail or keyed shape, which is received in a channel located in the support component 25 of the blocks 20 to ensure a good connection. However, mechanical fastening or other suitable means of connection could also be used. The blocks 20 can be assembled as a longer bar, if desired, and then cut to the length with a desired shape or configuration.

As shown in detail in FIG. 1, at least some of the blocks 20 are spaced apart to form at least one generally longitudinally oriented slot, and more preferably a plurality of CD extending slots through the cover 10. The shape and size of the at least one slot is determined by at least one of a location and a shape of the blocks 20 and the open spaces 24 between them. For example, as shown in FIG. 1, the blocks 20 may have a trapezoidal shape and are preferably arranged so that the at least one slot has an intermittent or somewhat discontinuous or non-linear appearance. The spacing between the open spaces 24 and the shape can be adjusted to any desired pattern. In the preferred application, a uniform but nonlinear slot width (in the MD) is provided across the entire length of the CD extending cover 10 over which the fabric 16 passes forming a non-continuous, non-linear slot. However, it could also be a continuous, non-linear slot as explained in more detail below.

As shown in FIGS. 1 and 3, the blocks 20 are supported by at least one longitudinally extending support 30. In the embodiment shown in FIGS. 1-3, two rows of blocks 20 are located between three longitudinal supports 30. The supports 30 extend in a CD and include a wear-resistant surface element 32 mounted in a support component 34 using an adhesive or potting compound 33. Preferably, the wear-resistant element 32 is formed of a ceramic material such as silicon nitride or aluminum oxide. However, other materials may be utilized which have a high wear resistance and smooth surface characteristics. The support component 34 is preferably formed of fiberglass, UHMW polyethylene, or stainless steel which has sufficient structural characteristics to support the wear-resistant element 32 as well as the adjacent blocks 20. However, other suitable materials could be utilized. The support component 34 generally extends across the entire length of the dewatering box 12 in the CD in the preferred embodiment. Preferably, CD grooves 36 are provided along the longitudinal edges of the support elements 34 in a uniform position to act as part of a holding mechanism for supporting the blocks 20.

In the preferred embodiment, the blocks 20 are aligned by at least one of a rod 38 or a groove 26 oriented generally parallel to and preferably engaged in the groove 36 of the at least one longitudinally extending support 30. As shown in FIG. 3, it is preferred that CD rods 38 extend longitudinally and are received in the grooves 36 in the supports 30. Corresponding grooves 26 are located in the blocks 20, and the rods 38 act as a key, locking the blocks 20 in position up and down so that the surface of the cover 10 defined by the wear-resistant components 22, 32 of the blocks 20 and supports 30 is at a uniform height and generally smooth. The blocks 20 can be adjusted in the CD to define a desired slot pattern for cover 10 of the vacuum dewatering box 12. In one preferred embodiment, the cover 10 includes first, second and third longitudinally extending supports 30 and a first group of the blocks 20 are located between the first and second longitudinally extending supports 30. A second group of blocks 20 are located between the second and third longitudinally extending supports 30. At least some of the blocks 20 of the first group are spaced apart from one another and at least some of the blocks 20 in the second group are spaced apart from one another and located in offset positions from the blocks 20 of the first group. This provides the zigzag or herringbone-shaped slot configuration as shown in FIG. 1. While one slot is shown in FIG. 1, multiple slots and/or various other configurations can be provided.

The supports 30 are preferably fastened or held in position across the opening of a cover frame member 50. This may be made of any suitable metal, fiberglass, UHMW polyethylene or any other suitable material. Generally, the cover frame member 50 has a large slot opening over which the assembled supports 30 and blocks 20 are located, to define the required slot configuration and to provide the wear-resistant components 22, 32, which contact the underside of the fabric or other element to be dewatered by the vacuum dewatering box 12. The frame member 50 provides a means to permit a variety of mounting configurations of the blocks 20 on the vacuum dewatering box 12 but, where appropriate, the supports 30 can be mounted directly to the box 12 rather than to the frame member 50 so that the frame member can be omitted.

It is possible to form the blocks 20 from the same material as the supports 30, with the blocks 20 being formed by cutting the material used to form a support 30 into specified lengths for the desired blocks 20.

Figure 4:
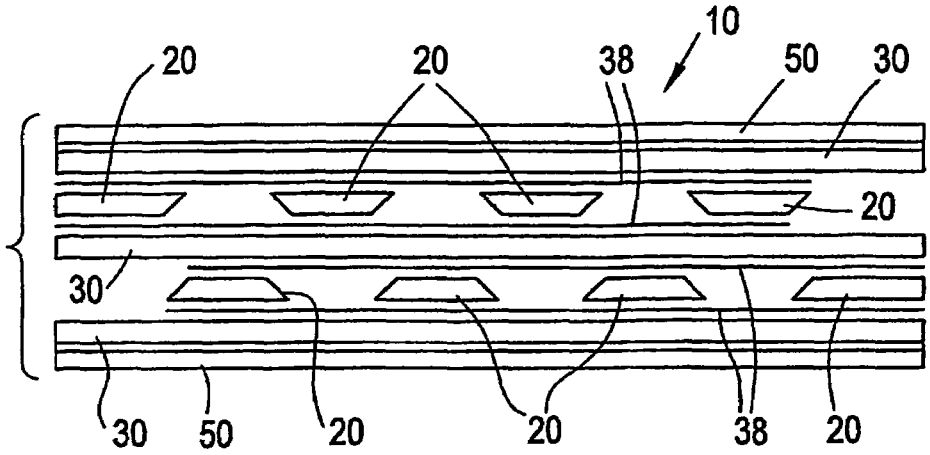
FIG. 4 is a plan view of the same embodiment of the suction box cover shown in FIG. 1, shown prior to assembly with the use of rods for alignment purposes.
Figure 5:
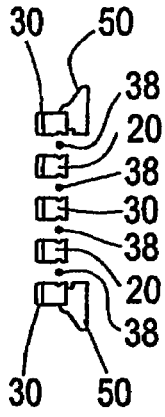
FIG. 5 is an end view of the disassembled cover of FIG. 4.

Referring now to FIGS. 4 and 5, the assembly of the cover 10 is shown with the spaced apart blocks 20 being located in the desired positions between the supports 30, and the rods 38 being positioned to lock the blocks 20 in position generally vertically. The cover 10 is then assembled by clamping the supports 30 and blocks 20 together and holding them in position, which may be accomplished via exterior clamping, bolts extending through the supports 30 and blocks 20, adhesives or other suitable means.

Figure 6:
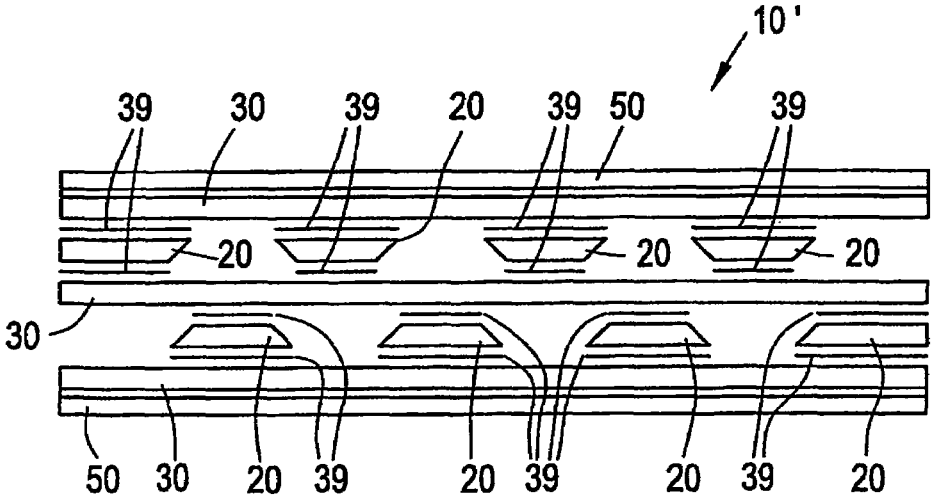
FIG. 6 is a plan view of the cover shown in FIG. 1, shown prior to assembly to illustrate the use of adhesive to attach the blocks to the CD elements.
Figure 7:
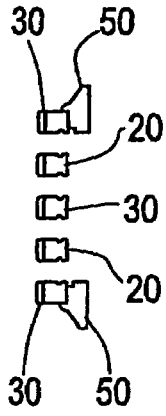
FIG. 7 is an end view of the cover of FIG. 6.

Referring now to FIGS. 6 and 7, an alternate assembly of the cover 10' is shown. The cover 10' is similar to the cover 10 except that the blocks 20 are held in position between the supports 30 using strips of adhesive 39 located on opposing sides of the blocks 20. The blocks 20 are placed in the desired positions and pressure is applied so that the blocks 20 are held firmly in position allowing the adhesive 39 to solidify between the support elements 30 forming the cover 10'. The adhesive 39 is preferably an epoxy which may be used independently or in conjunction with the rods 38.

Figure 8:
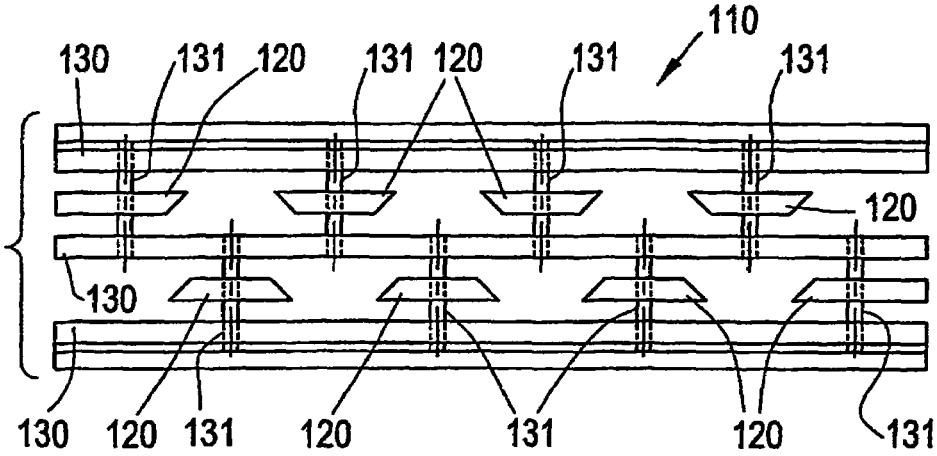
FIG. 8 illustrates the use of bolts or pins to secure the blocks to the CD elements.
Figure 9:
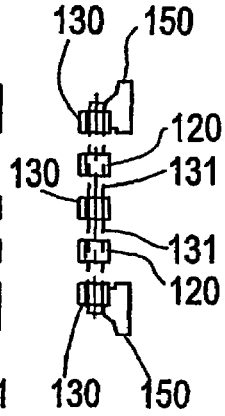
FIG. 9 is an end view of the cover of FIG. 8.

Referring now to FIGS. 8 and 9, an alternate construction for a cover 110 for a vacuum dewatering box 12 in accordance with the present invention is shown. The cover 110, shown disassembled in FIGS. 8 and 9, includes a plurality of blocks 120, which are formed in a similar manner to the blocks 20 discussed above, which are supported between CD extending supports 130. The blocks 120 are supported by cross-bolts 131, which extend through the blocks 120 and the adjacent supports 130. The bolts 131 may be formed of stainless steel or any other suitable material and extend through complementarily sized apertures in both the blocks 120 and supports 130. Preferably, the bolts 131 only extend through the support components and not through the ceramic or other type of wear component located on the upper surface of both the blocks 120 and the supports 130. Other suitable mechanical fasteners can be utilized, if desired, in order to hold the blocks 120 in position.

Figure 11:
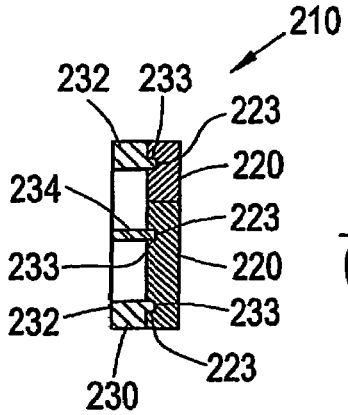
FIG. 11 is a cross-sectional view taken along line 11-11 in FIG. 10.
Figure 10:
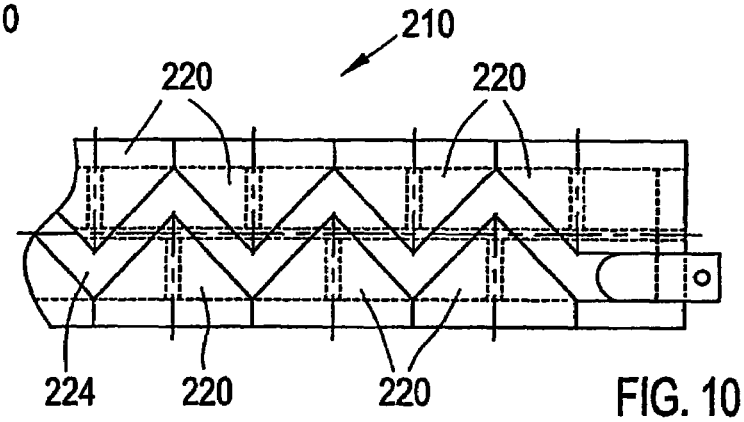
FIG. 10 is a plan view of a second embodiment of a vacuum dewatering box cover according to the present invention wherein triangular shaped blocks are attached to the CD elements, to form a continuous, non-linear slot.

Referring now to FIGS. 10 and 11, another embodiment of a cover 210 for a vacuum dewatering box in accordance with the present invention is shown. The cover 210 is formed from generally triangular-shaped blocks 220, which are arranged on a support structure 230, which extends in the CD. The support structure 230 preferably is formed of two longitudinally extending CD rails 232, located along each edge of the cover 210, and a center support 234, which also extends in a longitudinal direction. The blocks 220, which may be formed entirely of a wear-resistant material, such as a ceramic, or may be a composite design having only a ceramic wear surface, are located on top of the support structure 230 and held in position in order to form a wear-resistant surface with a continuous non-linear, zigzag-shaped slot 224. The center support 234 is partially exposed in the slot 224. However, this does not detract from the overall dewatering operation or the ability to form the zig-zag shaped slot 224 having a generally uniform area using a plurality of blocks 220. In the preferred embodiment, the blocks 220 include recesses 223, into which complementary-shaped projections 233 of the support member 230 extend. Preferably, the blocks 220 are held in position with an adhesive, potting compound or other suitable means in order to form the cover 210 with a highly wear-resistant surface that is both easy and cost effective to assemble. Any suitable combination of rods, pins, bolts and/or adhesive may be used to assemble the cover, and the specific assembly can be accomplished by any number of methods.

Figure 12:
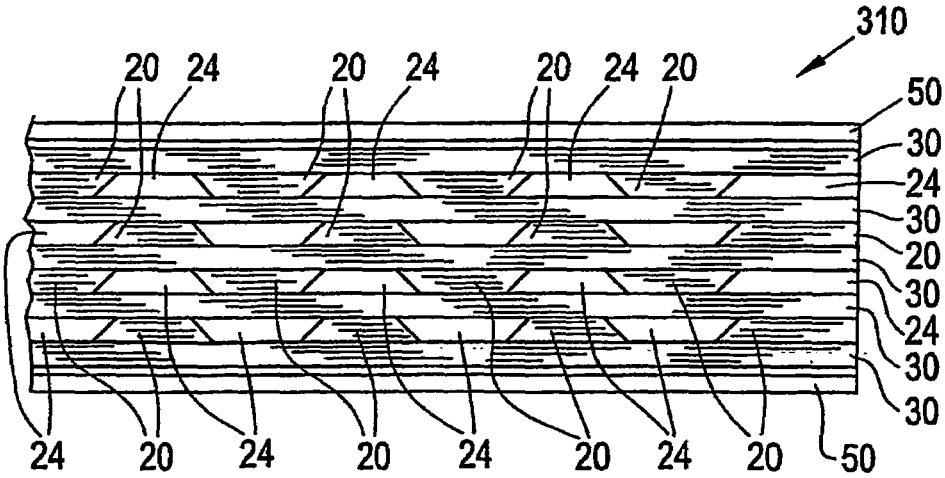
FIG. 12 is a plan view of a vacuum dewatering box cover according to the present invention, utilizing preferred trapezoidal shaped blocks to form a plurality of nonlinear, non-continuous slots.

Referring now to FIG. 12, the scalable nature of the cover 310 in accordance with the present invention is shown. Additional CD support elements 30 and groups of blocks 20 can be assembled together in the same manner as described above to form multiple zigzag or herringbone slots. The open spaces 24, as illustrated, collectively form two non-continuous, non-linear slots having a generally uniform MD width. Each of the non-continuous, non-linear slots is formed by two separate groups of spaced apart blocks 20, with each group being located between adjacent CD support elements 30, and the blocks 20 of each group being spaced apart, and at least some of the blocks 20 of one group being located in offset positions from at least some of the blocks 20 of the adjacent group. While the non-continuous, non-linear slots shown are each formed by two groups of blocks 20, it would also be possible to have a non-continuous, non-linear slot formed by three or more groups of blocks 20, with each group being located between successive adjacent CD support members 30.

For the preferred arrangement where each non-continuous, non-linear slot is formed by two groups of blocks 20, covers 310 of various widths can be formed by 2n+1 CD extending supports and 2n groups of blocks, where n is an integer greater than or equal to 1. Each of the groups of the blocks 20 are separately located between successive adjacent ones of the CD extending supports 30, and at least some of the blocks 20 in each of the 2n groups are spaced apart from one another, and at least some of the blocks 20 in a first of the 2n groups of blocks are located in offset positions from at least some of the blocks of a second of the 2n groups of blocks. As shown in FIG. 12, n=2. However, n could be varied.

While this produces a preferred configuration, the invention is not limited to this preferred configuration, and various other arrangements of the blocks 20 could be utilized depending on the particular application. Additionally, while it is preferred to have non-linear slots with a uniform MD width across the entire CD of the cover, this is not necessarily required for all applications, and the slots need not have the same MD width and could be shorter than the entire CD cover width.

The preferred application for the covers 10, 10', 110, 210 and 310 is for the vacuum dewatering box as described above. This can be a suction box located in the forming section of the papermaking machine, or a Uhle box located in the press section: both are used for dewatering a papermaking fabric and/or the paper being formed thereon. The invention is particularly advantageous when used as a Uhle box cover in that it reduces, in a very cost effective and simple manner, wear on the seam of a press felt.

In accordance with the invention, the cover for the vacuum dewatering box is formed by a plurality of blocks 20, 120, 220, each having at least a wear-resistant surface, which are modular components from which the cover 10, 10', 110, 210, 310 can be assembled at greatly reduced costs. This provides the benefits of a ceramic-wear surface which has a much higher longevity than the prior known UHMW polyethylene covers providing a zigzag or herringbone slot configuration.

The invention claimed is:

1. A cover for a vacuum dewatering box, comprising:

a plurality of blocks each including a wear surface, the blocks are arranged in at least one cross direction (CD) row and are spaced apart from one another in the cross direction to form at least one generally CD oriented non-linear shaped continuous or discontinuous slot through the cover in which no straight linear CD slot path is defined in the CD that extends across the cover, a shape and size of the at least one slot being determined by at least one of a location of and a shape of the blocks.

2. The cover for a vacuum dewatering box of claim 1, wherein the blocks are supported by at least one CD extending support.

3. The cover for a vacuum dewatering box of claim 1, wherein the wear surface of each of the blocks is mounted in a support component.

4. The cover for a vacuum dewatering box of claim 1, wherein the blocks are supported by at least one CD extending support, and the blocks are aligned by at least one of a rod or a groove oriented generally parallel to the at least one longitudinally extending support.

5. The cover for a vacuum dewatering box of claim 1, wherein the cover includes first, second and third CD extending supports, a first group of the blocks are located between the first and second CD extending supports, and a second group of blocks are located between the second and third CD extending supports, at least some of the blocks of the first group are spaced apart from one another, and at least some of the blocks in the second group are spaced apart from one another and located in offset position from the blocks of the first group.

6. The cover for a vacuum dewatering box of claim 5, wherein there is at least one additional CD extending support and at least one additional group of blocks located between the additional CD extending support and one of the other CD extending supports, and at least some of the blocks in the additional group are spaced apart from one another and located in offset positions from at least some of the blocks of the first or second groups.

7. The cover for a vacuum dewatering box of claim 5, wherein there is a plurality of generally CD oriented slots through the cover.

8. The cover for a vacuum dewatering box of claim 1, wherein the cover includes 2n+1 CD extending supports and 2n groups of blocks, where n is an integer greater than or equal to 1, each of the groups of the blocks are separately located between successive adjacent ones of the CD extending supports, at least some of the blocks in each of the 2n groups are spaced apart from one another, and at least some of the blocks in a first of the 2n groups of blocks are located in offset positions from at least some of the blocks of a second of the 2n groups of blocks.

9. The cover for a vacuum dewatering box of claim 1, wherein the box is one of a suction box or a Uhle box for a papermaking machine.

10. The cover for a vacuum dewatering box according to claim 9, wherein the wear surface of the blocks are formed entirely of a ceramic material selected from the group consisting of silicon nitride or aluminum oxide.

11. The cover for a vacuum dewatering box according to claim 9, wherein the blocks include one of a ceramic coating or wear resistant element located on a wear side.

12. A vacuum dewatering box for a papermaking machine, comprising:

a box with an interior adapted to be connected to a vacuum source, the box being adapted for installation in a cross direction (CD) across at least a portion of a papermaking machine;

a cover located on the box, the cover being formed from a plurality of blocks each including a fabric bearing wear surface, the blocks are arranged in at least one CD row and are spaced apart from one another in the CD to form at least one generally CD oriented non-linear shaped continuous or discontinuous slot in communication with the interior of the box, in which no straight linear CD slot path is defined in the CD that extends across the cover, a shape and size of the at least one slot being determined by at least one of a location of and a shape of the blocks.

13. The vacuum dewatering box according to claim 12, wherein the blocks are attached to at least one CD support by mechanical fasteners.

14. The vacuum dewatering box according to claim 12, wherein the blocks are attached to at least one CD support by at least one of bonding, welding, and adhesives.

15. The vacuum dewatering box of claim 12, wherein the fabric bearing wear surface of each of the blocks is mounted in a support component.

16. The vacuum dewatering box of claim 15, wherein the support component comprises a fiberglass, stainless steel or UHMW material.

17. The vacuum dewatering box of claim 15, wherein the support component of each of the blocks includes a channel to receive the wear resistant element.

18. The vacuum dewatering box according to claim 12, wherein the blocks are supported by at least one CD support, and the blocks are aligned by at least one of a rod or a groove oriented generally parallel to the at least one CD support.

19. The vacuum dewatering box according to claim 12, wherein the cover includes first, second and third CD supports, a first group of the blocks are located between the first and second CD supports, and a second group of blocks are located between the second and third CD supports, at least some of the blocks of the first group are spaced apart from one another, and at least some of the blocks in the second group are spaced apart from one another and located in offset positions from the blocks of the first group.

20. The vacuum dewatering box of claim 19, wherein there is at least one additional CD extending support and at least one additional group of blocks located between the additional CD extending support and one of the other CD extending supports, and at least some of the blocks in the additional group are spaced apart from one another and located in offset positions from at least some of the blocks of the first or second groups.

21. The vacuum dewatering box of claim 12, wherein there is a plurality of generally CD oriented slot through the cover.

22. The vacuum dewatering box of claim 12, wherein the cover includes 2n+1 CD extending supports and 2n groups of blocks, where n is an integer greater than or equal to 1, each of the groups of the blocks are separately located between successive adjacent ones of the CD extending supports, at least some of the blocks in each of the 2n groups are spaced apart from one another, and at least some of the blocks in a first of the 2n groups of blocks are located in offset positions from at least some of the blocks of a second of the 2n groups of blocks.

23. The vacuum dewatering box according to claim 12, wherein the blocks are formed entirely of a ceramic material.

24. The vacuum dewatering box according to claim 12, wherein the blocks include a ceramic coating located on a wear side.

25. The vacuum dewatering box of claim 12, wherein the vacuum dewatering box is a suction box or a Uhle box for a papermaking machine.

26. A vacuum dewatering box for a papermaking machine, comprising:

a box with an interior adapted to be connected to a vacuum source, the box being adapted for installation in a cross direction (CD) across at least a portion of a papermaking machine;

a cover located on the box, the cover being formed from a plurality of blocks each including a fabric bearing wear surface, the blocks are arranged in at least one CD row and are spaced apart from one another in the CD to form at least one generally CD oriented non-linear shaped slot in communication with the interior of the box, a shape and size of the at least one slot being determined by at least one of a location of and a shape of the blocks, wherein the blocks are supported by at least one CD support, and the blocks are aligned by at least one of a rod or a groove oriented generally parallel to the at least one CD support, and each of the blocks is supported by two of the CD supports, one of the CD supports extending along each longitudinal side of each of the blocks, the CD supports each including at least one of a longitudinally extending groove or projection, and each of the blocks including at least one of a complementary located groove or projection so that the blocks are positively engaged and held in position by the CD supports.

27. The vacuum dewatering box of claim 26, wherein the projection on the CD support is formed by a rod located in a groove in the CD support that protrudes outwardly.

* * * * *